US009617132B2

(12) United States Patent
Iotti

(10) Patent No.: US 9,617,132 B2
(45) Date of Patent: Apr. 11, 2017

(54) EQUIPMENT WITH SIDE-SHIFTER

(71) Applicant: MANITOU ITALIA S.R.L., Castelfranco Emilia (Modena) (IT)

(72) Inventor: Marco Iotti, Reggio Emilia (IT)

(73) Assignee: MANITOU ITALIA S.R.L., Castelfranco Emilia (IT)

( * ) Notice: Subject to any disclaimer, the term of this patent is extended or adjusted under 35 U.S.C. 154(b) by 85 days.

(21) Appl. No.: 14/920,969

(22) Filed: Oct. 23, 2015

(65) Prior Publication Data

US 2016/0176690 A1 Jun. 23, 2016

(30) Foreign Application Priority Data

Dec. 18, 2014 (IT) ..... MO2014A0362

(51) Int. Cl.
*B66F 9/14* (2006.01)
*B66F 9/18* (2006.01)

(52) U.S. Cl.
CPC ..... *B66F 9/143* (2013.01); *B66F 9/148* (2013.01); *B66F 9/18* (2013.01)

(58) Field of Classification Search
CPC ..... B66F 9/143; B66F 9/18
See application file for complete search history.

(56) References Cited

U.S. PATENT DOCUMENTS 4,189,275 A 2/1980 Arnold
5,088,880 A * 2/1992 Field, Jr. ..... B66F 9/143 414/667
5,096,363 A * 3/1992 Weinert ..... B66F 9/143 414/667
5,217,343 A 6/1993 Bostad et al.
5,336,039 A * 8/1994 House ..... B66F 9/183 294/119.1
2003/0156935 A1* 8/2003 Mondani ..... B66F 9/148 414/667
2010/0111647 A1* 5/2010 Noonan ..... A01D 87/127 414/24.5

FOREIGN PATENT DOCUMENTS

CN 102167269 A 8/2011
DE 202007006866 U1 8/2007
JP H11246197 A 9/1999

* cited by examiner

*Primary Examiner* — Kaitlin Joerger
(74) *Attorney, Agent, or Firm* — Pearne & Gordon LLP

(57) ABSTRACT

An equipment (1) for a lift truck or similar self-propelled work machines, comprising: a fixed frame (2) which can be mounted solidly constrained to an arm of said lift truck, a movable frame (3), to which a tool (41, 42) is fixed, and actuating means (5) for displacing said movable frame (3) with respect to said fixed frame (2).

The fixed frame (2) comprises a straight upper guide (22, 23) and a straight lower guide (24, 25) which lie on parallel or coincident planes. The movable frame (3) comprises upper connecting means (31, 32) and lower connecting means (33, 34) slidably coupled respectively to the upper guide (22, 23) and to the lower guide (24, 25) and coplanar thereto, so as to enable translation of the tool (41, 42) with respect to the fixed frame (2).

10 Claims, 7 Drawing Sheets

EQUIPMENT WITH SIDE-SHIFTER

The present invention relates to an equipment for lift trucks, handlers, aerial platforms or forklifts, for example of the telescopic type and possibly also of the rotary type.

There are known lift trucks comprising a vehicle equipped with a movable frame on tracks or wheels which mounts the driver's cab and a telescopically extendable maneuvering arm.

At the distal end of the arm, there is provided an equipment or "accessory" for lifting or moving loads, which comprises a tool such as a fork, a gripper and the like.

To be precise, the equipment is engaged releasably at the distal end of the arm through suitable attachment means.

Particularly where the tool is a fork or a gripper, the equipment comprises a sideshifting mechanism or "side-shifter" which allows the transverse movement of the tool with respect to the plane in which the maneuver arm lies.

For appreciating side-shifter's usefulness, think of the case in which it is necessary to replace hydraulic cylinders or wheels of large size earthmoving machinery used in mines and/or in the open air, or the like.

To perform this kind of operation, the operator shall first of all bring the equipment in proximity of the earthmoving machine.

At this stage, the tool, such as a gripper, can be placed by the operator directly near the load to be lifted, without any complicated driving maneuvers having to be performed.

Indeed, owing to the side-shifter, the tool position may be adjusted with great accuracy.

Then, the grip and transportation of the load are easy and safe.

Another important use of the side-shifter, implies accurate positioning of the loads in the designated areas.

Indeed, just think to the case in which the loads shall be shifted onto warehouse shelvings, such as for example pallets which are moved by equipment supplied with forks.

In such circumstances, a high positioning accuracy is required, since the available space is according the encumbrance of the specific load which is to be accommodated.

The sideshifting mechanisms currently used are composed of a fixed part, which is mounted integral with the arm, and a movable part integral with the tool, and therebetween actuating means are interposed for translating the movable part relative to the fixed part.

The movable part of the side-shifters in the prior art is attached to the front side of the fixed part by means of couplings between pins and special bearings, or alternatively by means of prismatic sliding couplings, wherein the latter are defined for example by slide shoes sliding along special machined guides.

The construction and maintenance of the side-shifters of the known type is rather complex and expensive and requires a considerable number of components subject to wear, besides implying use of machining processes which are not yet fully automated.

In this context, the technical task at the base of the invention is to propose an equipment for lift trucks which provides the sideshifting feature, thereby enabling to overcome the drawbacks of the prior art.

The technical task mentioned is attained by the equipment built in accordance with claim 1.

Further characteristics and advantages of the invention will become more apparent from the indicative, and therefore non-limiting, description of a preferred but non-exclusive embodiment of a loading equipment for lift trucks as illustrated in the accompanying drawings wherein.

Figure 1:
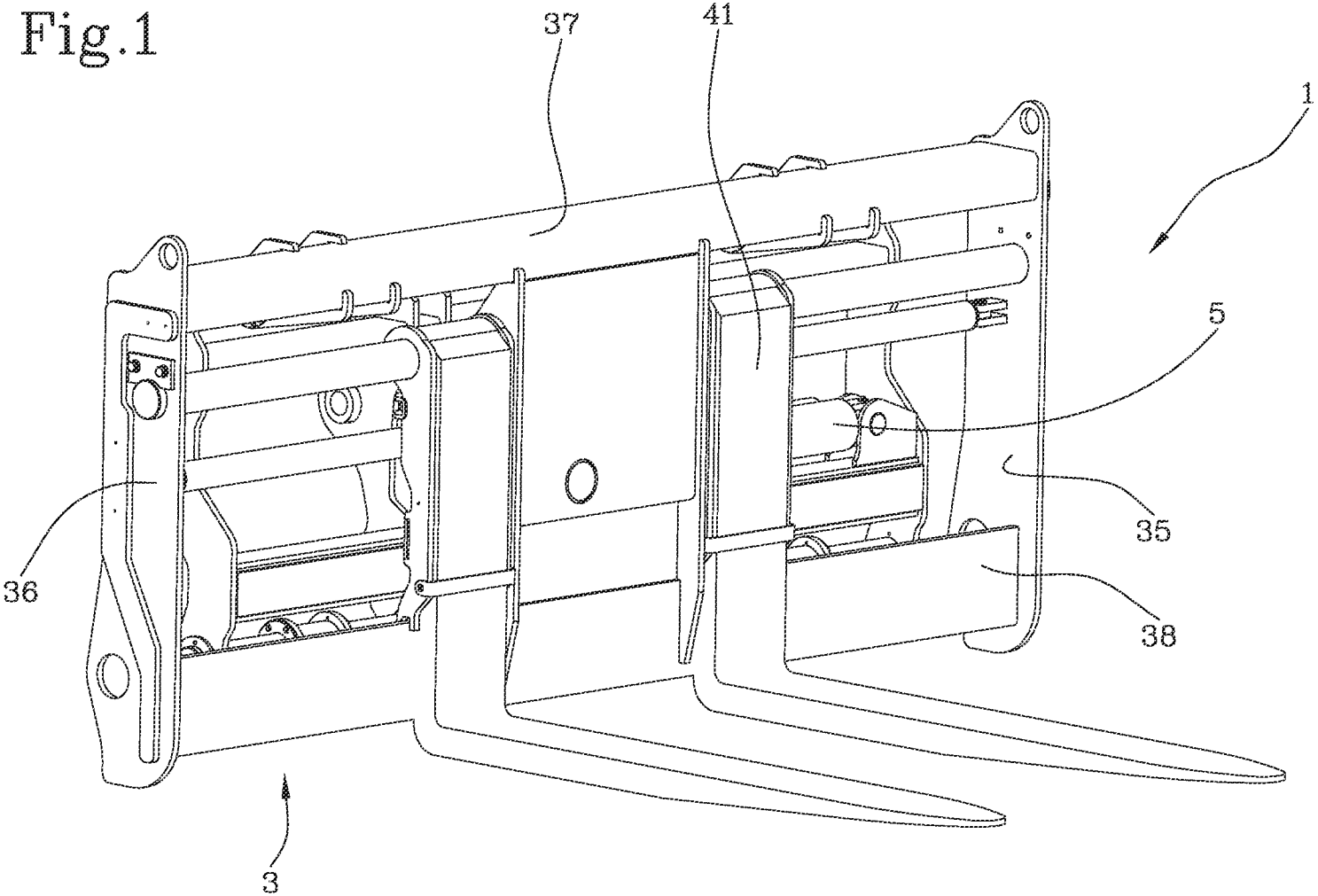
FIG. 1 is a front isometric view of the equipment of the invention, provided with a first type of tool.
Figure 2:
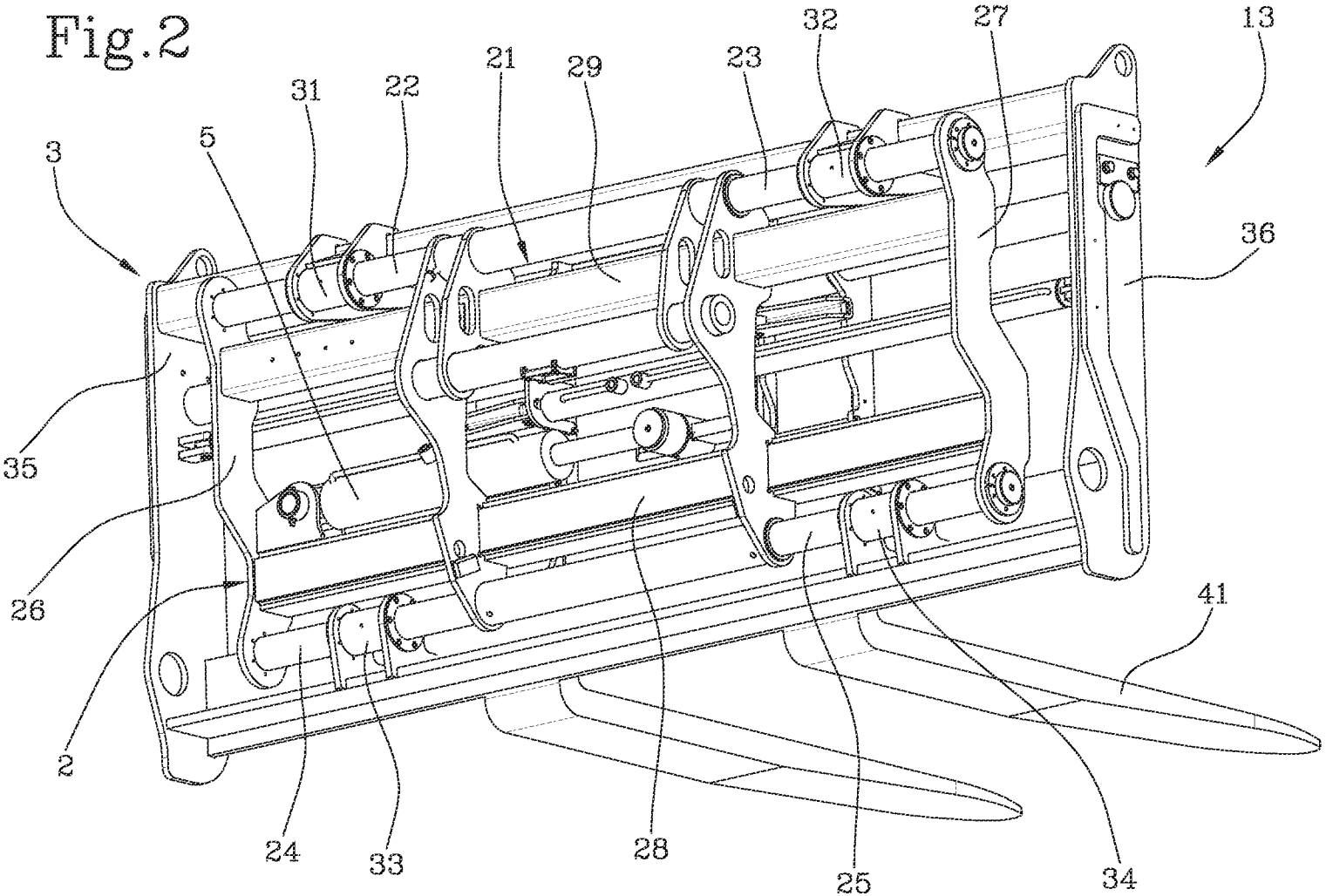
FIG. 2 is a rear axonometric view of the equipment of the preceding figure.
Figure 3:
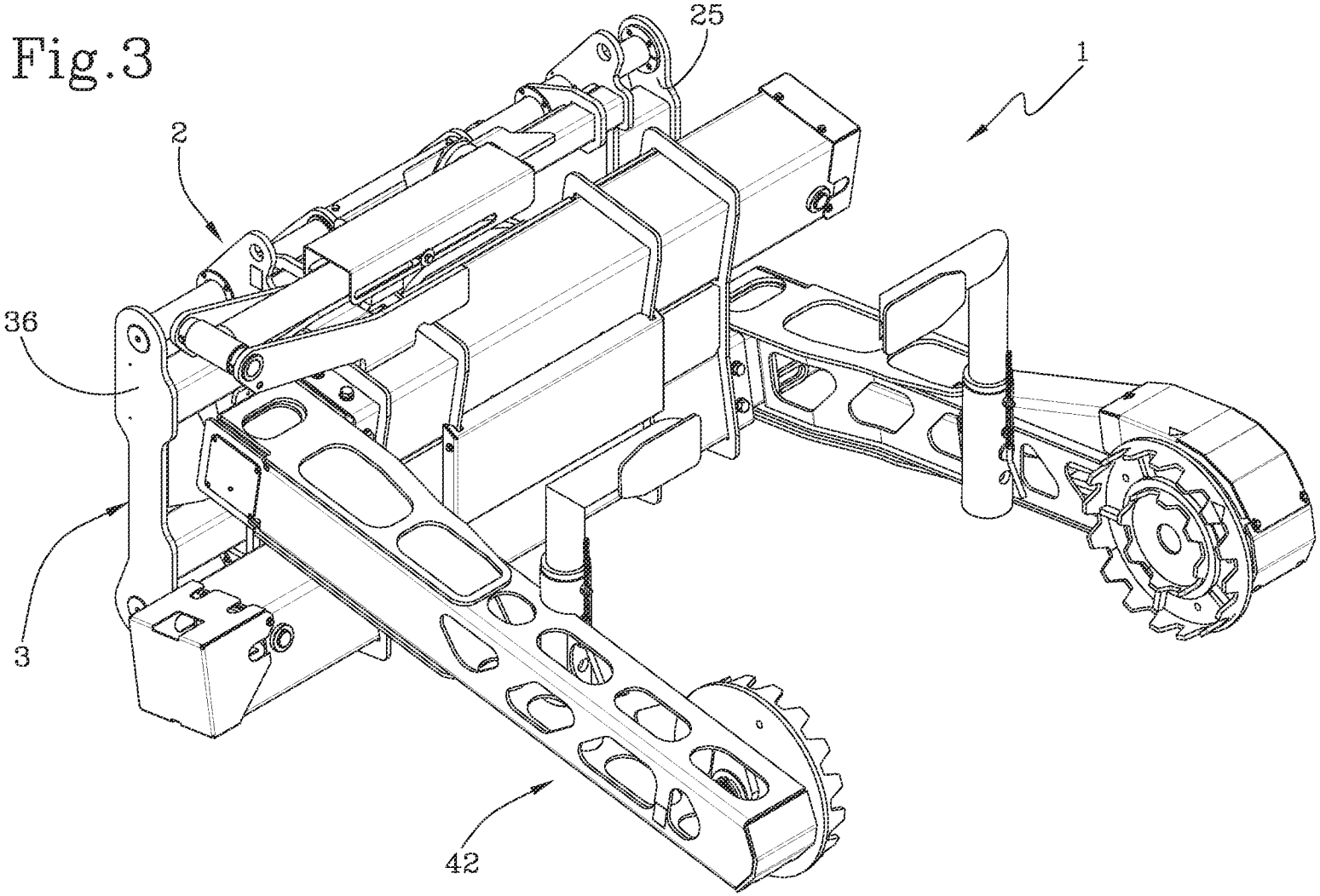
FIG. 3 is a front isometric view of the equipment of the invention, provided with a second type of tool.
Figure 4:
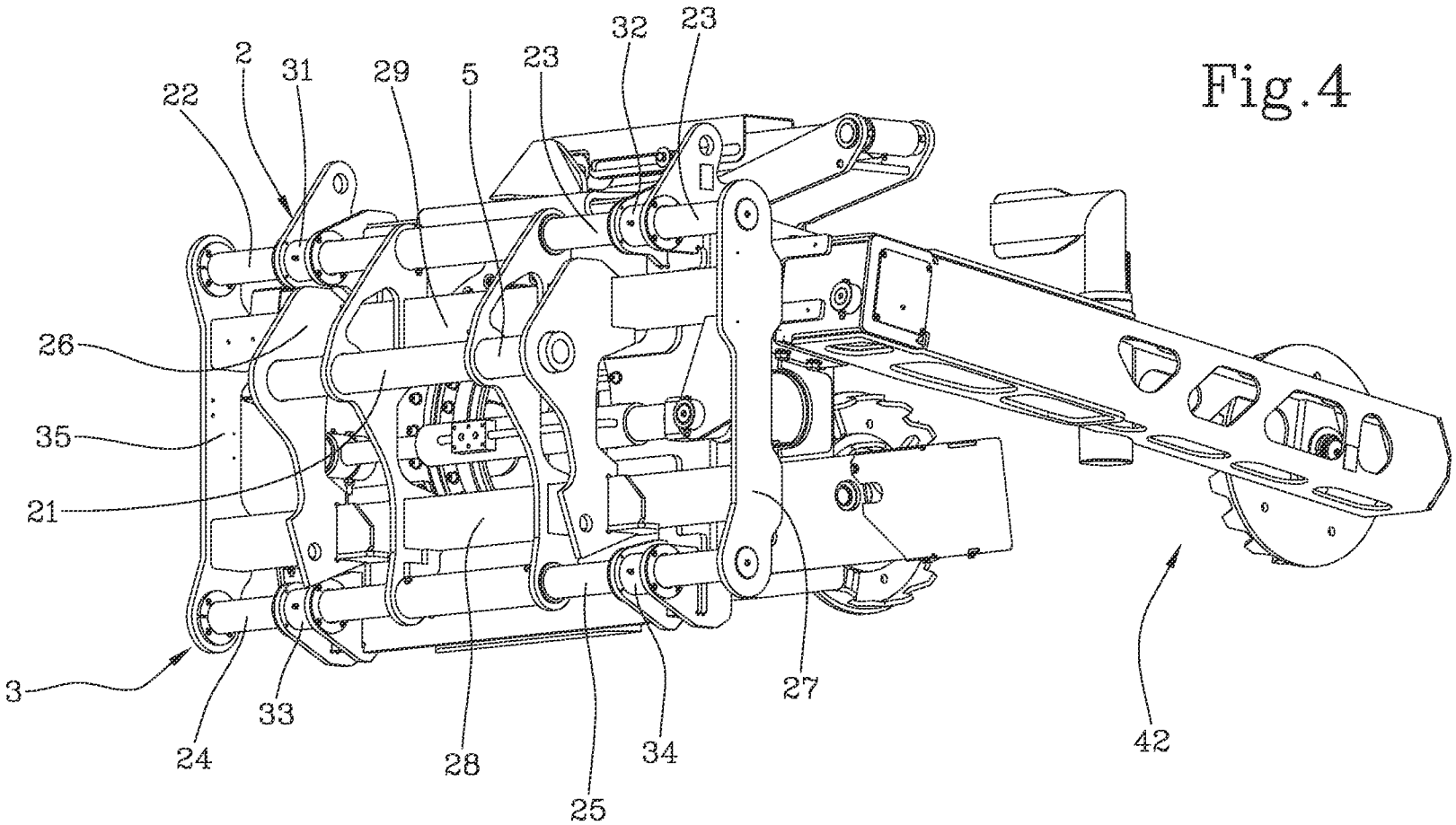
FIG. 4 is a rear axonometric view of the equipment of the preceding figure.

Referring to the attached figures, by 1 it is indicated the equipment of the invention.

The equipment proposed is intended to be mounted on a lift truck or similar self-propelling work machines of the type previously already described.

The equipment 1 comprises first of all a fixed frame 2 exhibiting a perimeter of substantially quadrangular shape, which is intended to be mounted solidly constrained with the lift arm of the lift truck or other similar machine.

The equipment 1 further comprises a movable frame 3 suitable for translating with respect to the fixed frame 2 and having a generally quadrangular perimeter, to which movable frame a gripping tool 41, 42 is fixed.

The frames of the equipment 1 have a development generally planar and are essentially placed opposite one to another, in close proximity and mutually connected.

In detail, the two frames 2, 3 are arranged transversally to the lift arm, and then develop perpendicularly to the plane in which said lift arm is placed. More precisely, the fixed frame 2 is preferably symmetrical with respect to the plane on which the axis of the arm lies.

The movable frame 3 may be symmetrical with respect to its own transverse median plane which under certain operational conditions may coincide with the symmetry plane of the fixed frame 2.

The movable frame 3 may slide in directions perpendicular to said plane and to said arm axis, which directions are, in use, substantially horizontal. Preferably, the two frames 2, 3 of the equipment 1 herein described, have a rectangular perimeter, wherein the respective longer sides are transverse to the plane of the arm; then the movable frame 3 is adapted to translate along a direction defined by the longitudinal extension thereof, which direction is also parallel to the longitudinal development of the fixed frame 2.

It should be appreciated that the movable frame 3 is preferably longer and wider than the fixed frame 2; this aspect is however not mandatory. The movable frame 3 comprises a front side relative to which the tool 41, 42 is fixed and an opposite back side facing the front side of the fixed frame 2.

The fixed frame 2 has then a rear side at which the arm is fixed.

In detail, the fixed frame 2 may comprise a rear attachment organ 21, i.e. placed on the rear side, and adapted to be removably fastened to suitable gripping means of the arm provided at its distal end.

The tool can be of various types, such as a fork 41 as illustrated in FIGS. 1, 2, 5, 6 and 7 or a gripper 42 as shown in the remaining figures, or still other types.

The tools 41, 42 comprised in the inventive equipment 1 can also be of the known type, thus structure and operation thereof are not described hereinafter.

According to an important aspect of the invention, the fixed frame 2 comprises a straight upper guide 22, 23 as well as a straight lower guide 24, 25, all of them lying on parallel or coincident planes, being preferably perpendicular to the plane of the arm.

The lower guide 24, 25 can be arranged, by way of example, in an ideal plane which is front to the plane in which the upper guide 22, 23 is placed; different configurations are however not to be excluded.

In addition, the movable frame 3 comprises, preferably at the rear side, upper connecting means 31, 32 and lower connecting means 33, 34, which are slidably coupled, respectively, to the upper guide 22, 23 and the lower guide 24, 25, thereby allowing the tool 41, 42 to translate with respect to the fixed frame 2.

The upper connecting means 31, 32 and the lower connecting means 33, 34 are respectively coplanar to the upper guide 22, 23 and the lower guide 24, 25.

In order for the movable frame 3 to be translated with respect to the fixed frame 2, there are provided actuating means 5 which are arranged between the two frames 2, 3, in a manner detailed hereinafter.

The side-shifter in accordance with the invention is defined by the slidable coupling between the movable frame 3 and the fixed frame 2 which is subject to the actuation of the actuating means 5.

In the preferred embodiment of the invention, shown in the attached figures, the upper and lower guides each comprise at least one linear element 22, 23, 24, 25.

Preferably, each guide comprises two coaxial linear elements which can each comprise a circular profile 22, 23, 24, 25 and which constrain the translation of the movable frame 3.

In this case, aforesaid connecting means each comprise at least one tubular element 31, 32, 33, 34 wherein the respective linear element 22, 23, 24, 25 is inserted.

In detail, if the linear elements 22, 23, 24, 25 are cylindrical as in the case of the circular profiles, then to each of them a cylindrical sliding sleeve 31, 32, 33, 34 will be coupled which is comprised in the connecting means of the movable frame 3.

In the preferred embodiment, the fixed frame 2 is provided with two pairs of circular profiles 22, 23, 24, 25, or cylindrical bars being coaxial two by two, said pairs being disposed on respective parallel or coincident planes. In practice, the movable frame 3 is slidingly coupled to the fixed frame 2 by means of four sleeves 31, 32, 33, 34, each coaxial with the relative profile 22, 23, 24, 25.

The profiles 22, 23, 24, 25 act as guides during translation and are solidly constrained with the lift arm, while the sleeves 31, 32, 33, 34 are the means through which the movable frame 3 is attached to the fixed frame 2 thus being able to translate.

Preferably, the fixed frame 2 comprises a support structure 26, 27, 28, 29 in turn comprising opposite lateral end members 26, 27, joined by one or more cross members 28, 29 being parallel to above mentioned upper and lower guides 22, 23, 24, 25.

The end members of the fixed frame 2 may include respective shaped plates 26, 27.

Figure 5:
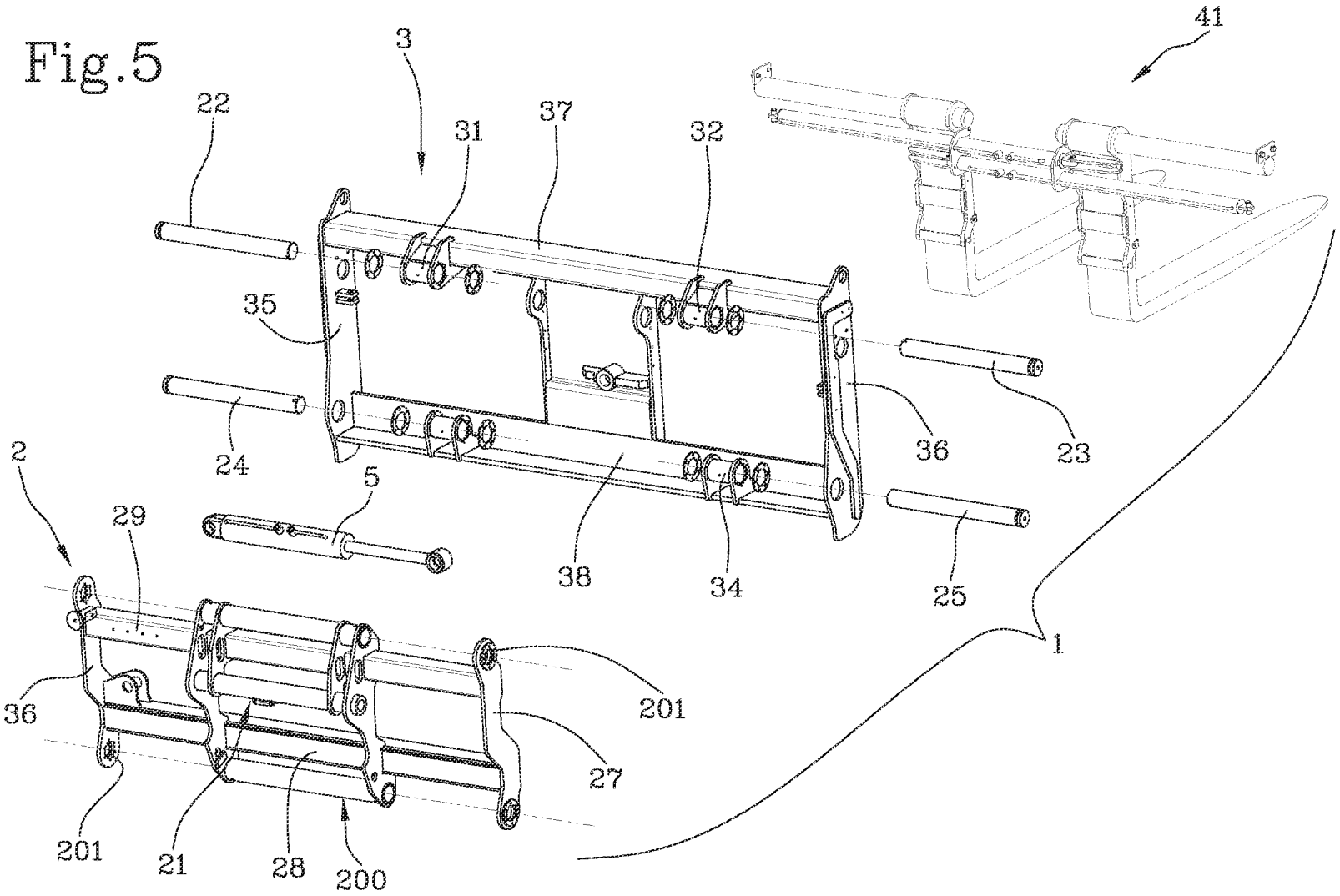
FIG. 5 is an exploded axonometric view of the equipment of the invention.

The aforementioned attachment organ 21 may be included within a central connecting structure 200 which is arranged centrally to the fixed frame 2 and in particular to its support structure 26, 27, 28, 29 (see for example FIG. 5).

In other words, said central structure 200 is fixed to above mentioned cross members 28, 29 at the rear side of the fixed frame 2 and may comprise a pair of side plates which contain the attachment organ 21 that can be defined by one or more tubular beams, according to known methods.

The above-mentioned linear elements 22, 23, 24, 25, in particular the circular profiles, may be placed between the central structure 200 and the end members 26, 27.

In detail, the end members 26, 27 may comprise respective through holes 201, shown in FIG. 5, suitable for receiving respective linear guide elements 22, 23, 24, 25 during assembly of the fixed frame 2.

To be precise, one end of a linear element 22, 23, 24, 25 is fixed relative to the respective through hole 201 of the end member 26, 27, while the other end is fixed within one of said tubular beams.

According to a preferred embodiment of the invention, the aforesaid actuating means comprise an actuating device 5, for example a hydraulic cylinder which is hinged to both the movable frame 3 and the fixed frame 2 and coplanar with one of said cross members of the fixed frame 2. In the preferred embodiment of the invention, the movable frame 3 comprises a support structure 35, 36, 37, 38, to which the tool 41, 42 is fixed in the front position, and to which the connecting means 31, 32, 33, 34 are fixed in the rear position.

The support structure is formed by two end members 35, 36, comprising for example respective plates joined by an upper cross member 37 and by a lower cross member 38.

According to an advantageous preferential embodiment, the support structure 35, 36, 37, 38 of the movable frame 3 defines an inner space which houses at least partially the fixed frame 2, thereby defining a very compact side-shifter with reduced transverse dimensions.

The aforementioned pairs of sleeves 31, 32, 33, 34 of the connecting means may be connected to respective cross members 37, 38 being larger than the support structure of the movable frame 3 due to lateral fastening flanges.

Herein below there are illustrated the operation and the advantages of the inventive equipment 1.

When the lift truck, or other work machine, is brought in proximity of a load to be taken, such as a wheel or an hydraulic cylinder destined to mining machines, the equipment 1 is advanced by the operator toward the load who moves the arm of the equipment.

At this point, the tool 41, 42 is suitably positioned by the operator relative to the load through use of the side-shifter in the following manner.

In practice, the hydraulic cylinder 5 of the equipment 1 is so controlled as to extend or retract the piston rod according to the direction toward which the movable frame 3 shall translate with respect to the fixed frame 2.

Figure 6:
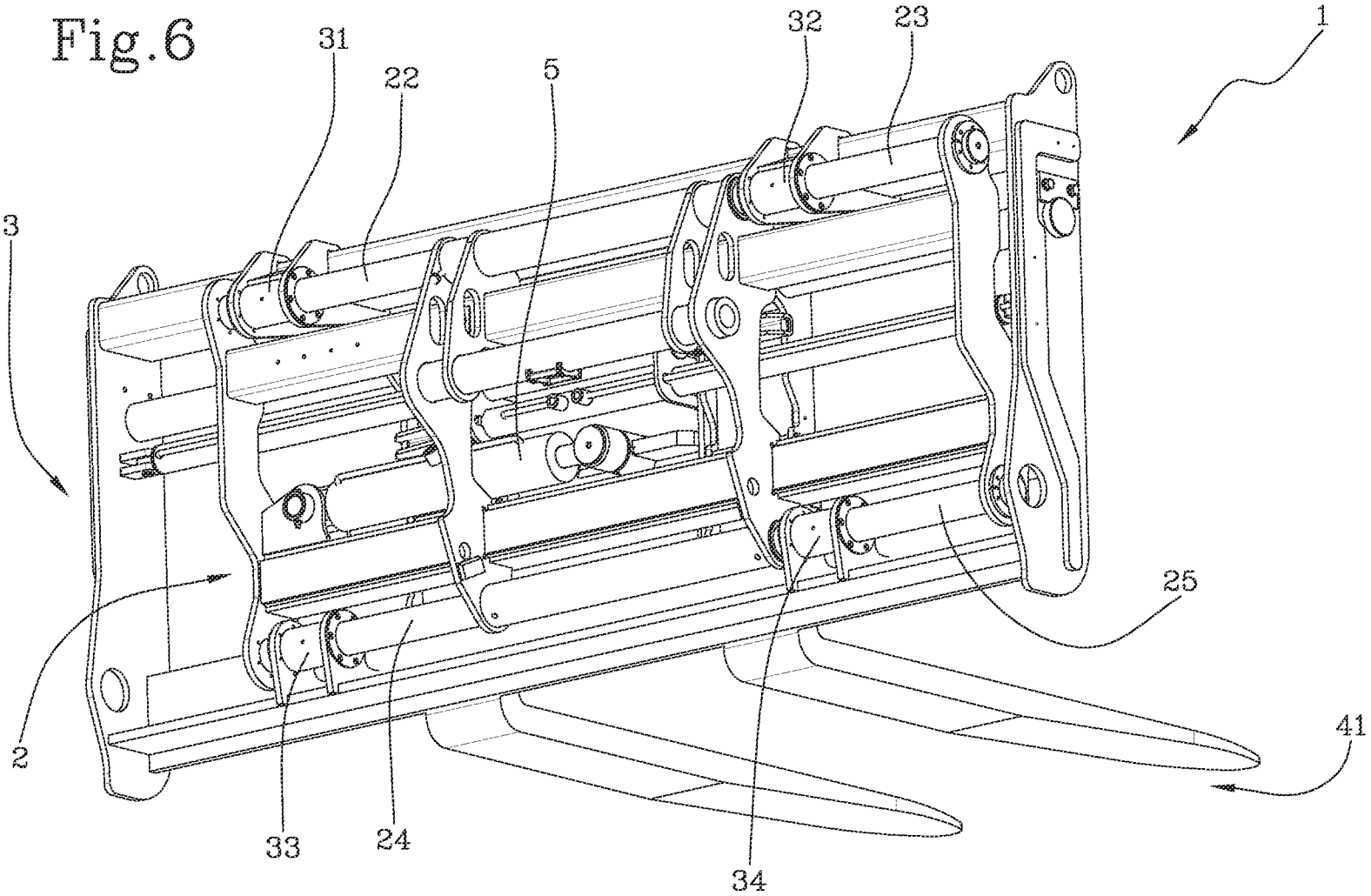
FIGS. 6 and 7 are the same view of the equipment shown in FIG. 2, in which the invention is represented in two different operational steps.
Figure 7:
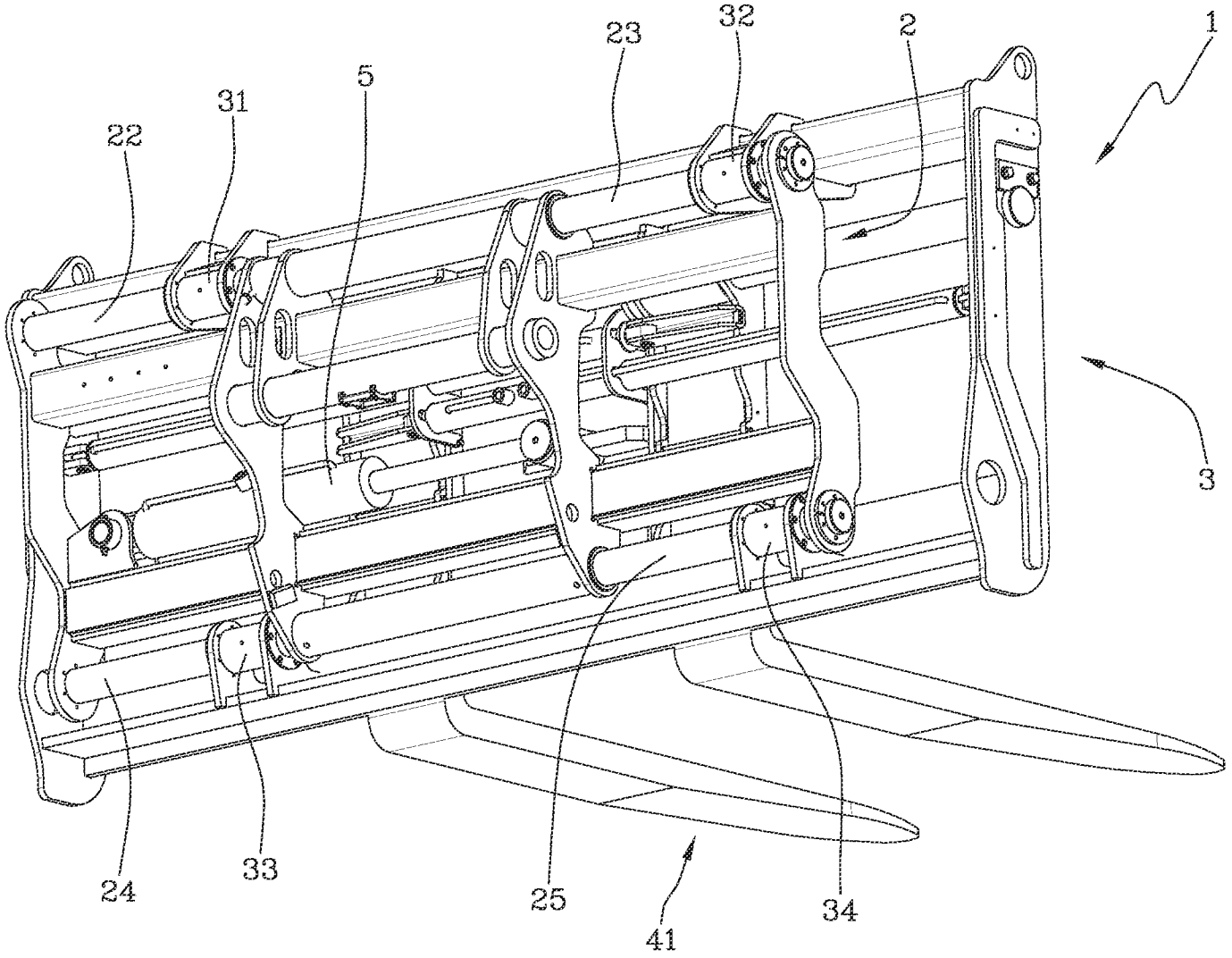

Referring to the illustrative and non-limiting arrangement of the actuating means 5 shown in the appended figures, it should be appreciated that, if the tool 41, 42 shall move to the left with respect to the front direction of the lift truck, the hydraulic cylinder 5 is actuated based on retrieval and the sleeves 31, 32, 33, 34 of the connecting means of the movable frame 3 slide to the left along the profiles 22, 23, 24, 25 of the guides of the fixed frame 2, as shown in FIG. 6.

Conversely, if the tool 41, 42 shall move to the right, the hydraulic cylinder 5 is actuated by push and the movable frame 3 slides to the left with respect to the fixed frame 2 which, of course, remains stationary relative to the arm.

The proposed equipment 1 performs sideshifting owing to a simpler and more economical design than the prior art, in that the movable and fixed frames 2, 3 basically are formed by plates, profiles and sleeves.

In other words, the components of the frame herein described, can be manufactured in a very simple way, particularly by using conventional machine tools, for the benefit of production in terms of speed and cost-saving.

Additionally, the very plain design of the inventive equipment implies a less frequent and easier maintenance, in that the equipment 1 is lacking of any slide shoes, teeth and bearings employed in the prior art.

Additionally, the small components number forming the two frames 2, 3 and the fact that they are defined by plates joined one to another by cross members, results in the overall structure of the inventive equipment 1 being much lighter than the prior art, which implies that, unlike the equipment in the prior art, with same load capacity, the loads in this case can be moved at a greater distance from the frame of the work machine.

Indeed, because of the lower weight of the equipment 1, despite the load being carried farthermost from the machine frame by the lift arm thereof, the mechanical moment acting on the whole machine structure remains rather limited unlike the prior art, thus being any the risk of tilting prevented.

In other terms, as said in the jargon, under equal load conditions, the equipment herein disclosed allows a longer reach range than the prior art. Conversely, since the inventive equipment 1 is lighter than the ones in the prior art, it follows that here, heavier loads can be handled under equal reach range conditions.

Further, as mentioned above, the equipment 1 herein provided is extremely compact, wherein it exhibits particularly reduced transverse dimensions, due to the fact that the fixed frame 2 is at least partly comprised within the movable frame 3 and to the fact that the hydraulic cylinder is coplanar to one of the cross beams of the fixed frame.

Advantageously, this allows to keep the center of gravity of the equipment close to the lift arm, thereby further increasing the distance from the machine frame, at which distance the load can be carried by the lift arm without this generating any danger of tipping.

Finally, it should be appreciated that, unlike some side-shifters of the prior art, the proposed apparatus 1 can be tilted downwards or upwards, that is, by rotating with respect to an axis transverse to the arm, without this affecting the performance of the inventive equipment in any manner.

The invention claimed is:

1. An equipment (1) for a lift truck or similar self-propelling work machines, comprising: at least a fixed frame (2) which can be mounted solidly constrained to an arm of said lift truck, at least a movable frame (3), to which a tool (41, 42) is fixed, and actuating means (5) for displacing said movable frame (3) with respect to said fixed frame (2), wherein the fixed frame (2) comprises at least a straight upper guide (22, 23) and at least a straight lower guide (24, 25) which lie on parallel or same planes; wherein the movable frame (3) comprises upper connecting means (31, 32) and lower connecting means (33, 34) slidably coupled respectively to the upper guide (22, 23) and to the lower guide (24, 25) and coplanar thereto, so as to enable translation of the tool (41, 42) with respect to the fixed frame (2);

wherein the movable frame (3) is longer and wider than the fixed frame (2);

wherein the movable frame (3) comprises a support structure (35, 36, 37, 38), to which the tool (41, 42) is fixed in the front position, and to which the connecting means (31, 32, 33, 34) are fixed in the rear position;

said support structure being formed by two end members (35, 36) joined by an upper cross member (37) and by a lower cross member (38).

2. The equipment (1) according to claim 1, wherein the movable frame (3) comprises a front side at which the tool (41, 42) is fixed, and an opposite rear side provided with said upper and lower connecting means (31, 32, 33, 34).

3. The equipment (1) according to claim 1, wherein said upper and lower guides each comprise at least a linear element (22, 23, 24, 25).

4. The equipment (1) according to claim 3, wherein said upper and lower connecting means each comprise at least a tubular element (31, 32, 33, 34) in which a respective linear element (22, 23, 24, 25) is inserted, said tubular element being slidable along the relative linear element.

5. The equipment (1) according to claim 1, wherein the fixed frame (2) comprises a rear attachment organ (21) able to be removably fixed to said arm.

6. The equipment (1) according to claim 1, wherein the fixed frame (2) comprises a support structure (26, 27, 28, 29) in turn comprising opposite lateral end members (26, 27), joined by one or more cross members (28, 29).

7. The equipment (1) according to claim 3, wherein the fixed frame (2) comprises a rear attachment organ (21) able to be removably fixed to said arm, wherein the fixed frame (2) comprises a support structure (26, 27, 28, 29) which in turn comprises opposite lateral end members (26, 27) joined by one or more cross members (28, 29), and wherein the rear attachment organ (21) is arranged centrally to the fixed frame (2) and wherein said upper guide (22, 23) comprises at least two upper linear elements (22, 23), and wherein said lower guide (24, 25) comprises at least two lower linear elements (24, 25), said upper linear elements and said lower linear elements being arranged between said rear attachment organ (21) and said end members (26, 27).

8. The equipment (1) according to claim 6, wherein said actuating means comprise an actuating device (5) connected both to the movable frame (3) and to the fixed frame (2) and coplanar to one of said cross members of the fixed frame (2).

9. The equipment (1) according to claim 1, wherein the movable frame (3) comprises a support structure (35, 36, 37, 38) to which said connecting means (31, 32, 33, 34) are fixed.

10. The equipment (1) according to claim 9, wherein said structure of the movable frame (3) defines an internal space which at least partly houses the fixed frame (2).

* * * * *